US010582820B2

(12) United States Patent
Lauer

(10) Patent No.: US 10,582,820 B2
(45) **Date of Patent: *Mar. 10, 2020**

(54) VACUUM CLEANER INCLUDING FOAM BODY

(71) Applicant: TTi (Macao Commercial Offshore) Limited

(72) Inventor: Robert Lauer, Charlotte, NC (US)

(73) Assignee: TTI (Macao Commercial Offshore) Limited, Praia Grande (MO)

( * ) Notice: Subject to any disclaimer, the term of this patent is extended or adjusted under 35 U.S.C. 154(b) by 47 days.

This patent is subject to a terminal disclaimer.

(21) Appl. No.: 15/958,587

(22) Filed: Apr. 20, 2018

(65) Prior Publication Data

US 2018/0235418 A1 Aug. 23, 2018

Related U.S. Application Data

(63) Continuation of application No. 15/229,510, filed on Aug. 5, 2016, now Pat. No. 10,219,664.
(Continued)

(51) Int. Cl.
*A47L 9/00* (2006.01)
*A47L 9/16* (2006.01)
(Continued)

(52) U.S. Cl.
CPC ..... *A47L 9/0063* (2013.01); *A47L 5/24* (2013.01); *A47L 5/36* (2013.01); *A47L 7/0019* (2013.01); *A47L 9/1683* (2013.01); *A47L 9/2884* (2013.01)

(58) Field of Classification Search
CPC . A47L 9/0063; A47L 5/24; A47L 5/36; A47L 7/0019; A47L 9/1683; A47L 9/2884
See application file for complete search history.

(56) References Cited

U.S. PATENT DOCUMENTS 3,308,608 A 3/1967 Brimberg
4,670,701 A 6/1987 Sako et al.
(Continued)

FOREIGN PATENT DOCUMENTS

CN 2484028 4/2002
CN 2877538 3/2007
(Continued)

OTHER PUBLICATIONS

Australian Patent Office Examination Report for Application No. 2016302353 dated Jul. 26, 2018, 5 pages.
(Continued)

*Primary Examiner* — Dung Van Nguyen
(74) *Attorney, Agent, or Firm* — Michael Best & Friedrich LLP

(57) ABSTRACT

A vacuum cleaner including a body formed by a foam material, the body having a first end and a second end. The vacuum cleaner further includes an air inlet adjacent the first end, an air outlet, and an airflow passage that extends from the air inlet to the air outlet. A suction source is disposed within the body operable to generate an airflow that travels from the air inlet through the air outlet. A separator is in communication with the airflow passage operable to filter dirt from the airflow. A battery is releasably mounted to a battery receiving portion operable to supply power to the suction source when the battery is mounted to the battery receiving portion and the battery receiving portion is in the second end of the body.

20 Claims, 17 Drawing Sheets

Related U.S. Application Data

(60) Provisional application No. 62/201,470, filed on Aug. 5, 2015, provisional application No. 62/243,858, filed on Oct. 20, 2015.

(51) Int. Cl.

| | |
|---|---|
| ***A47L 5/24*** | (2006.01) |
| ***A47L 9/28*** | (2006.01) |
| ***A47L 5/36*** | (2006.01) |
| ***A47L 7/00*** | (2006.01) |

(56) References Cited

U.S. PATENT DOCUMENTS

| | | | |
|---|---|---|---|
| 5,067,584 | A | 11/1991 | Williams et al. |
| 5,737,797 | A | 4/1998 | Rittmueller et al. |
| 5,836,046 | A | 11/1998 | Huffman et al. |
| 6,115,879 | A | 9/2000 | Mitchell |
| 6,295,692 | B1 | 10/2001 | Shideler |
| 6,341,403 | B1 | 1/2002 | Strickrodt et al. |
| 6,393,656 | B1 | 5/2002 | Paterson et al. |
| 6,473,933 | B1 | 11/2002 | Paterson et al. |
| 6,779,228 | B2 | 8/2004 | Plomteux et al. |
| 7,404,230 | B1 | 7/2008 | Phillips |
| 7,434,657 | B2 | 10/2008 | Nieschwitz et al. |
| 7,509,706 | B2 | 3/2009 | Clarke |
| 9,131,816 | B2 | 9/2015 | Pruitt |
| 9,277,844 | B1 | 3/2016 | Millan |
| 10,219,664 | B2 * | 3/2019 | Lauer ..... A47L 5/24 |
| 2003/0014831 | A1 | 1/2003 | Ma |
| 2004/0088817 | A1 | 5/2004 | Cochran et al. |
| 2006/0070797 | A1 | 4/2006 | Nieschwitz et al. |
| 2007/0174992 | A1 | 8/2007 | Murray et al. |
| 2016/0293912 | A1 | 10/2016 | Manion |

FOREIGN PATENT DOCUMENTS

| | | |
|---|---|---|
| CN | 100372490 | 3/2008 |
| CN | 103784081 | 5/2014 |
| CN | 203802387 | 9/2014 |
| CN | 204581145 | 8/2015 |
| GB | 2431097 | 4/2007 |
| GB | 2502131 | 11/2013 |
| WO | 2016085540 | 6/2016 |

OTHER PUBLICATIONS

International Search Report and Written Opinion for Application No. PCT/US2016/045747 dated Nov. 24, 2016 (10 pages).
Australian Patent Office Action for Application No. 2016302353 dated Jul. 5, 2019 (6 pages).

* cited by examiner

VACUUM CLEANER INCLUDING FOAM BODY

CROSS-REFERENCE TO RELATED APPLICATIONS

This application is a continuation of U.S. patent application Ser. No. 15/229,510, filed Aug. 5, 2016, which claims priority to U.S. Provisional Patent Application No. 62/201,470, filed on Aug. 5, 2015 and U.S. Provisional Patent Application No. 62/243,858, filed on Oct. 20, 2015, the entire content all of which are incorporated herein by reference.

BACKGROUND

The present invention relates to a vacuum cleaner and more particularly to a carrier for a vacuum cleaner.

SUMMARY

In one embodiment, a vacuum cleaner and carrier assembly includes a vacuum cleaner and a carrier. The vacuum cleaner includes a housing having a suction inlet and an air outlet, an airflow passage that extends from the air inlet to the air outlet, and a suction source disposed within the housing and operable to generate a suction airflow that travels through the air inlet and through the air outlet. The vacuum cleaner also includes a battery that supplies power to the suction source to generate the suction airflow. The carrier includes a main body in which at least a portion of the housing is received and a battery receiving portion configured to receive the battery therein when the battery supplies power to the suction source.

In another embodiment, a carrier for a supporting a vacuum includes a main body in which at least a portion of the vacuum cleaner is received, and a battery receiving portion configured to receive a battery therein. The carrier also includes a battery receptacle supported within the battery receiving portion. The battery cooperates with the battery receptacle to supply power to the vacuum cleaner.

In another embodiment, a carrier for a supporting a vacuum cleaner includes a main body in which at least a portion of the vacuum cleaner is received and a plenum in fluid communication with the portion of the vacuum cleaner. The plenum includes at least one opening and is configured to receive an exhaust airflow generated by the vacuum cleaner during operation and to discharge the exhaust airflow through the at least one opening.

In another embodiment, a vacuum cleaner and carrier assembly includes a vacuum cleaner and a carrier. The vacuum cleaner includes a housing having an air inlet and an air outlet, an airflow passage that extends from the air inlet to the air outlet, and a suction source disposed within the housing and operable to generate an airflow that travels through the air inlet and through the air outlet. The carrier includes a first compartment in which at least a portion of the housing is received, and a second compartment pivotably coupled with the first compartment.

In another embodiment, a vacuum cleaner and carrier assembly includes a vacuum cleaner and a carrier. The vacuum cleaner includes a housing having an air inlet and an air outlet, an airflow passage that extends from the air inlet to the air outlet, and a suction source disposed within the housing and operable to generate an airflow that travels through the air inlet and through the air outlet. The carrier includes a first compartment including a main body in which at least a portion of the housing is received. The main body includes a flexible foam material.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
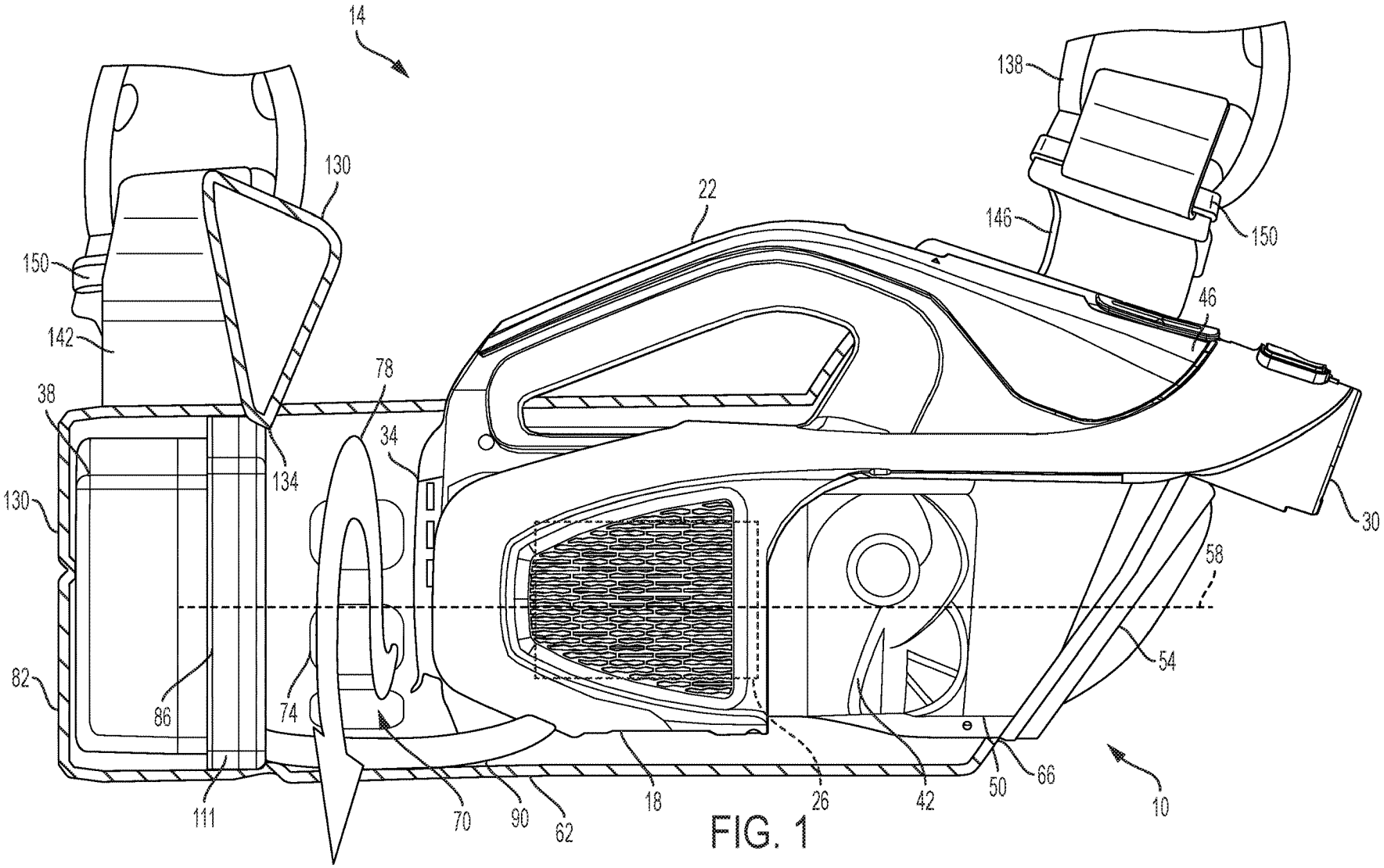
FIG. 1 is a side view of a vacuum cleaner and carrier assembly according to a first embodiment.

FIG. 1 illustrates a first embodiment of a vacuum cleaner and carrier assembly including a vacuum cleaner 10 and a carrier 14. The illustrated vacuum cleaner 10 includes a housing 18, a handle 22 extending from the housing 18, and a suction source 26 (e.g., an electric motor and fan assembly) received within the housing 18. The suction source 26 is operable to generate an airflow from an air inlet or suction inlet 30 to an air outlet 34. In the illustrated embodiment, the suction source 26 is powered by a battery 38; however, in other embodiments, the suction source 26 can be powered by a conventional wall outlet via a power cord.

With continued reference to FIG. 1, the illustrated air inlet 30 and air outlet 34 are located at generally opposite ends of the vacuum cleaner 10. A cleaning wand, hose, or other attachment (not shown) can be coupled to the vacuum cleaner 10 at the air inlet 30 to provide a desired cleaning configuration. The vacuum cleaner 10 further includes a separator 42, which is a cyclonic separator in the illustrated embodiment, to filter dirt and debris from air entering the inlet 30 before the air is discharged through the outlet 34. In other embodiments, the separator 42 can be a filter bag or other filtered separator designs not incorporating cyclonic action or in combination with cyclonic action. An inlet duct 46 extends from the air inlet 30 to the separator 42.

The vacuum cleaner 10 also includes a dirt bin 50 coupled to the housing 18 to collect the dirt and debris filtered from the air by the separator 42. A door 54 is provided on the dirt bin 50 to allow the dirt bin 50 to be emptied while it remains in position on the vacuum cleaner 10. In the illustrated embodiment, the dirt bin 50, the separator 42, the suction source 26, and the air outlet 34 are all generally aligned along a longitudinal axis 58 of the vacuum cleaner 10.

Figure 2:
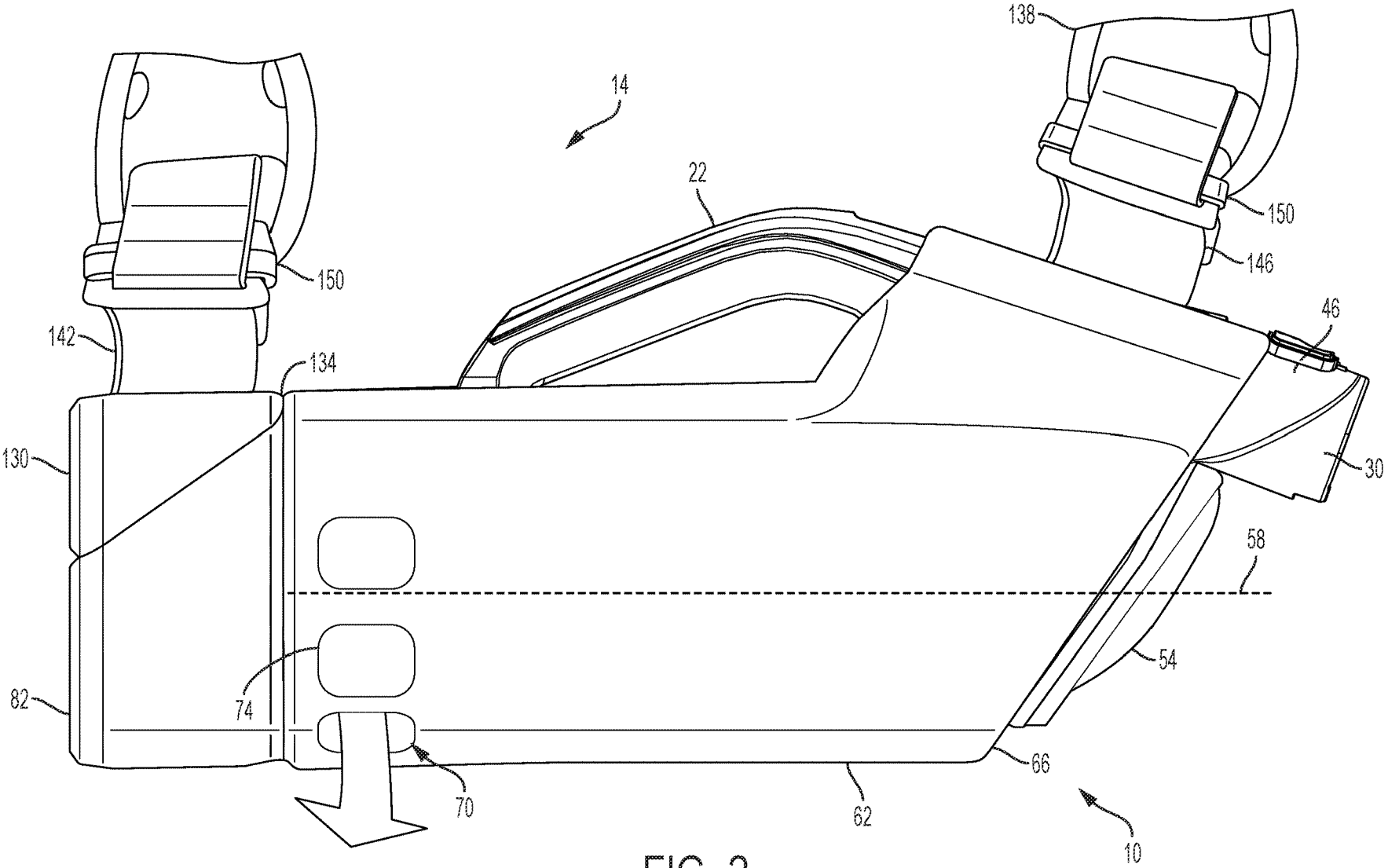
FIG. 2 is a side view of the vacuum cleaner and carrier assembly of FIG. 1.

With reference to FIGS. 1 and 2, the carrier 14 includes a first compartment defining a main body 62 in which at least a portion of the vacuum cleaner 10 is received such that the main body 62 enwraps at least a portion of the housing 18. In the illustrated embodiment, the main body 62 substantially enwraps the housing 18. Also shown in the illustrated embodiment, the separator 42, the dirt bin 50, and a portion of the inlet duct 46 are also received within and enwrapped by the main body 62. The inlet duct 46 and the dirt bin door 54 may extend beyond a front end 66 of the main body 62 such that the door 54 and the air inlet 30 are accessible to a user of the vacuum cleaner 10 as shown for example in FIG. 2. In alternate embodiments, the main body 62 may partially or fully enwrap the dirt bin door 54 but the main body 62 configured to be openable by the user such that the door 54 is accessible. The handle 22 also extends beyond the main body 62 and is accessible to the user. The main body 62 includes a closure (not shown), which can include a zipper, Velcro, snaps, or other means suitable for facilitating removal of the vacuum cleaner 10 from the carrier 14. Alternatively, the main body 62 may be permanently secured around the vacuum cleaner 10. In some embodiments, the main body 62 includes perforations (not shown) to allow ambient air to flow through the main body 62 to cool the vacuum cleaner 10.

In the illustrated embodiment, the main body 62 includes a flexible and resilient foam material, such as a flexible foam of polyurethane, polyether, polyisocyanurate, rubber, or any combinations thereof, or other polymeric foams. Optionally, the main body is covered with an outer layer of textile, film, or cladding covering material providing one or more surface properties such as water repellency, griping surface, soft surface, other tactile surface, chemical resistance, protective surface, strength, reinforcement, reflective or high-visibility surface, decoration, or other properties as desired. The optional covering material can include natural fibers, artificial fibers, polymers, metallic materials, or a combination thereof. The foam and optional covering material construction of the main body 62 can provide the vacuum cleaner 10 with additional protection from drops or other impacts. Additionally, the sound dampening properties of selected foam used in the construction of the main body 62 may reduce the sound of the motor and airflow in the vacuum cleaner during use. In addition, the water repellency of the selected foam may help to water proof the vacuum cleaner 10 to reduce bacteria growth in wet environments.

The first compartment of the carrier 14 further defines a plenum 70 in fluid communication with the air outlet 34. (FIG. 1). The plenum 70 is configured to receive an exhaust airflow generated by the suction source 26 during operation and discharge the exhaust airflow through at least one opening. In the illustrated embodiment, the plenum 70 is an extension of the main body 62 and is made of the same foam construction. In other embodiments, the plenum 70 can include a separate chamber coupled to the main body 62 and can be made of the same or different materials.

The illustrated plenum 70 is approximately the same circumferential shape of the main body 62, which in the exemplary embodiment is generally cylindrical, but the plenum 70 could have other shapes corresponding with the design of the main body 62. The illustrated plenum 70 includes a plurality of circumferentially-spaced openings 74 through which the exhaust airflow is discharged from the plenum 70. In the illustrated embodiment, the vacuum cleaner 10 is generally oriented in the carrier 14 to introduce the exhaust airflow into the plenum 70 in a first direction, and at least one opening 74 is oriented to discharge the exhaust airflow in a second direction different than the first direction. For example, the air outlet 34 may be oriented to introduce the exhaust airflow into the plenum 70 in one or more lateral directions transverse to the longitudinal axis 58, and the openings 74 may be oriented to discharge the exhaust airflow in a plurality of radially-outward (or alternatively downward) directions. This change in flow direction, along with sound dampening properties of selected foam used in the construction of the plenum 70, can dampen noise produced by the vacuum cleaner 10 during operation and contribute to a reduced operating volume.

In some embodiments, the plenum 70 includes one or more flow affecting features, such as vanes, protrusions, and the like, to create a tortuous path 78 through the plenum 70 between the air outlet 34 and the openings 74. For example, the plenum 70, openings 74, and/or flow affecting features may be constructed to impart a swirling motion in the exhaust airflow. The tortuous path 78 can provide additional noise dampening. In some embodiments, the plenum 70 includes one or more internal supports to help define the shape of the plenum 70 and to inhibit the plenum 70 from being compressed or otherwise deformed in manner that would inhibit airflow through the air outlet 34 or the openings 74. The supports may also act as flow affecting features. For example, the supports may guide the exhaust airflow through to openings 74 and contribute to creating the tortuous path 78. In yet another alternative, the plenum 70 includes one or more flow affecting features to create a smooth path through the plenum 70 between the air outlet 34 and the openings 74, reducing pressure drop in the flow between the air outlet 34 and the openings 74.

Referring to FIG. 1, the illustrated carrier 14 includes a second compartment defining a battery receiving portion 82 having a battery receptacle 86 supported therein, which is in electrical communication with the suction source 26 of the vacuum cleaner 10. The battery 38 is connectable to the battery receptacle 86 to provide power to the suction source 26 and may be removable from the receptacle 86 for storage, recharging, replacement, and the like.

In the illustrated embodiment, the battery receiving portion 82 is positioned adjacent the plenum 70, such that the plenum is 70 disposed between the battery receiving portion 82 and the vacuum cleaner 10. A power cord or wire 90 extends from the receptacle 86 and through the plenum 70 to transmit power from the battery 38 to the suction source 26. In other embodiments, the wire 90 extends outside of the plenum 70, and in some embodiments, the battery receiving portion 82 can be positioned in other locations (e.g., on a belt, sling, or harness remote from the main body 62).

Figure 4B:
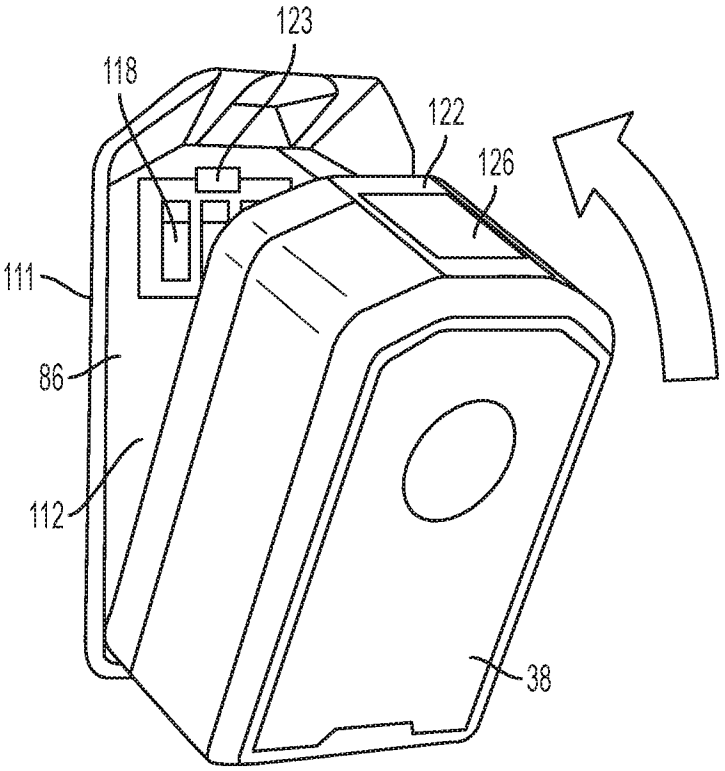
FIG. 4B illustrates the battery of FIG. 4A being coupled to a receptacle.
Figure 4A:
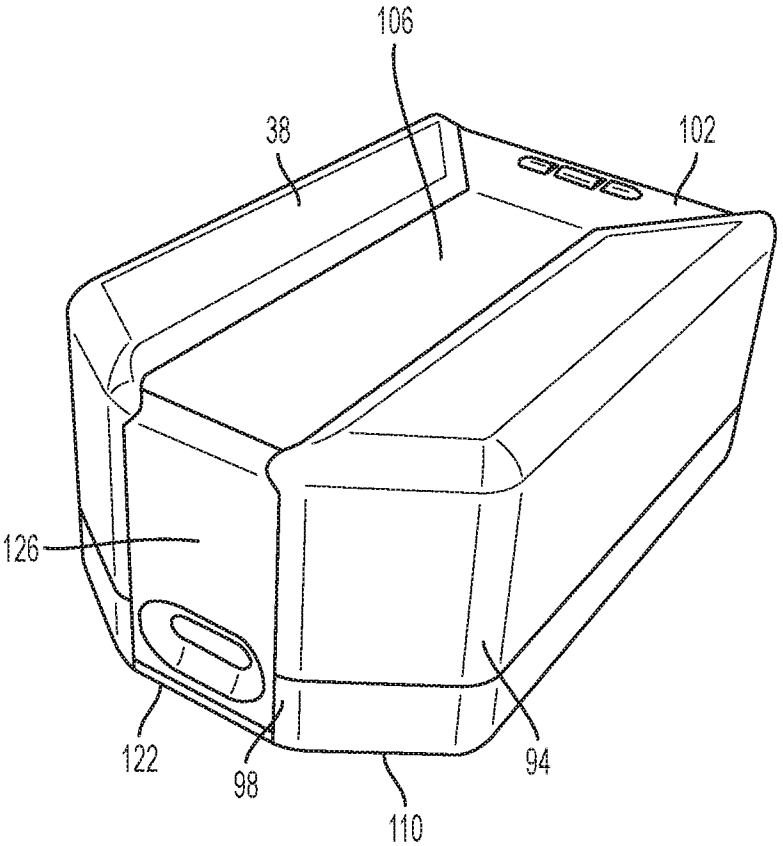
FIG. 4A illustrates a battery for use with the vacuum cleaner and carrier assembly of FIG. 1.

With reference to FIG. 4A, the battery 38 is configured as a rechargeable battery pack and includes a housing 94 having a front side 98, a back side 102, a top side 106, and a bottom side 110. As used herein, "front," "back," "top," and "bottom" are used for convenience of illustration and are not necessarily related to the orientation of the battery relative to the product or relative to a use position. The housing 94 encloses one or more rechargeable cells (not shown). The cells can be arranged in series, parallel, or a series-parallel combination to provide a desired nominal voltage and capacity. In the illustrated embodiment, the battery 38 has a nominal voltage of about 20 volts; however, the voltage can be any other voltage selected for use with the particular design of the vacuum cleaner 10, for example 12 volt, 40 volt, or any other desired voltage. In some embodiments, the battery 38 is a lithium-ion type battery, having lithium-based cells with a chemistry of, for example, lithium-cobalt, lithium-manganese, or lithium-manganese spinel. Alternatively, the cells can have any other suitable chemistry. In other embodiments, other types of batteries can be utilized, such as nickel-cadmium, nickel metal hydride, lead-acid, or any other battery type.

Referring to FIG. 4B, the illustrated receptacle 86 includes a receiving surface 112, which is sized and shaped to receive the bottom side 110 of the battery housing 94. Optionally, an outer wall 111 may surround the receiving surface 112 to aid in locating and seating the battery 38. The illustrated battery 38 includes contacts 114 such as prongs on the bottom side 110 that are engageable with receiving contacts 118 on the receptacle 86 to electrically connect the battery 38 with the receptacle 86. In the illustrated embodiment, the contacts 114 are positioned on the bottom side 110 proximate the front side 98. However, the contacts 114 generally are positioned on the battery housing 94 on any side to engage the receiving contacts 118 on the receptacle 86.

With reference to FIGS. 4A and 4B, a latching mechanism 122 may be provided on the battery 38 to secure the battery 38 to the receptacle 86. The illustrated latching mechanism 122 includes a hook (not shown) engageable with a tab 123 on the receptacle 86. The latching mechanism 122 also includes a release button 126 on the front side 98 of the housing 94 to selectively disengage the hook from the tab 123. The tab 123 is located on the receptacle 86 proximate the receiving contacts 118, and the hook is located on the battery 38 proximate the prongs 114. Alternatively, the latching mechanism 122 can be located on the receptacle 86 and the tab 123 can be located on the battery housing 94. In other embodiments, the latching mechanism 122 can include one or more rails, channels, detents, spring-loaded elements, or other latching features engageable with corresponding features on the receptacle 86 to releasably secure the battery 38 to the receptacle 86.

In other embodiments, the receptacle 86 can engage with the battery 38 in other ways. For example, in some embodiments, the receptacle can be a cap or plug having the receiving contacts 118 to receive the prongs 114 on the battery 38 but not including the receiving surface 112. In such embodiments, the receptacle 86 may be substantially smaller than the battery 38.

Referring to FIGS. 1 and 2, the battery receiving portion 82 has a lid 130 that is movable to an open position to facilitate insertion or removal of the battery 38 from the battery receiving portion 82. In the illustrated embodiment, the lid 130 is pivotally connected to the remainder of the battery receiving portion 82 by a thin strip of material 134 that acts as a hinge. In other embodiments, the lid 130 may be separable from the remainder of the battery receiving portion 82 or coupled to the remainder of the battery receiving portion 82 in other ways. When the lid 130 is closed, the battery 38 is substantially enclosed within the battery receiving portion 82. In some embodiments, the lid 130 may be secured in the closed position by snaps, Velcro, a zipper, or other suitable means. In other embodiments, the lid 130 may be omitted. Furthermore, the battery receiving portion 82 need not encapsulate the battery 38, but may only receive a portion of the battery 38.

The illustrated battery receiving portion 82 is made of the same foam and optional covering material construction as the main body 62. Accordingly, the battery receiving portion 82 can provide the battery 38 and battery receptacle 86 with additional protection from drops and impacts. In other embodiments, the battery receiving portion 82 can include other materials. For example, the battery receiving portion 82 may include one or more relatively rigid supports to inhibit the battery receiving portion 82 from being compressed or otherwise deformed.

The receptacle 86 can be made of plastic, metal, or any other suitable material or combination of materials. In the illustrated embodiment, the receptacle 86 is made of a relatively rigid material compared to the battery receiving portion 82. In the illustrated embodiment, the receptacle 86 is formed separately and permanently affixed within the battery receiving portion 82 by stitching, mechanical fasteners, adhesive, or any other suitable means. Alternatively, the receptacle 86 can be removable from the battery receiving portion 82 (e.g., to facilitate engaging or disengaging the battery 38 from the receptacle 86). In such embodiments, the wire 90 may be detachable from the receptacle 86, the vacuum cleaner 10, or both.

With reference to FIGS. 1 and 2, the vacuum cleaner and carrier assembly may include a shoulder sling 138. The shoulder sling 138 has a first end 142 coupled to the battery receiving portion 82 and a second end 146 coupled to the main body 62. In other embodiments, one or both ends 142, 146 can be directly coupled to the main body 62 or housing 18. In some embodiments, one or both ends 142, 146 can include clips such that the shoulder sling 138 may be selectively attached or detached from the remainder of the vacuum cleaner and carrier assembly. The shoulder sling 138 may be adjustable in length, for example, using adjustment buckles 150 or other fasteners that allow the length of the shoulder sling 138 to be adjusted. In other embodiments, the carrier 14 includes a shoulder harness (not shown) for carrying as a back-pack. For certain types or sizes of vacuum cleaners, the carrier 14 can also include a waist or hip belt to provide additional support or additional storage for carrying items such as batteries, cleaning attachments, cleaning supplies, or other items. In some embodiments, the battery receiving portion 82 can be positioned on the waist or hip belt, shoulder sling, or shoulder harness remote from the main body 62 with the power cord or wire 90 extending from the receptacle 86 to the vacuum cleaner 10 in the carrier 14 to transmit power from the battery 38 to the suction source 26.

Figure 3:
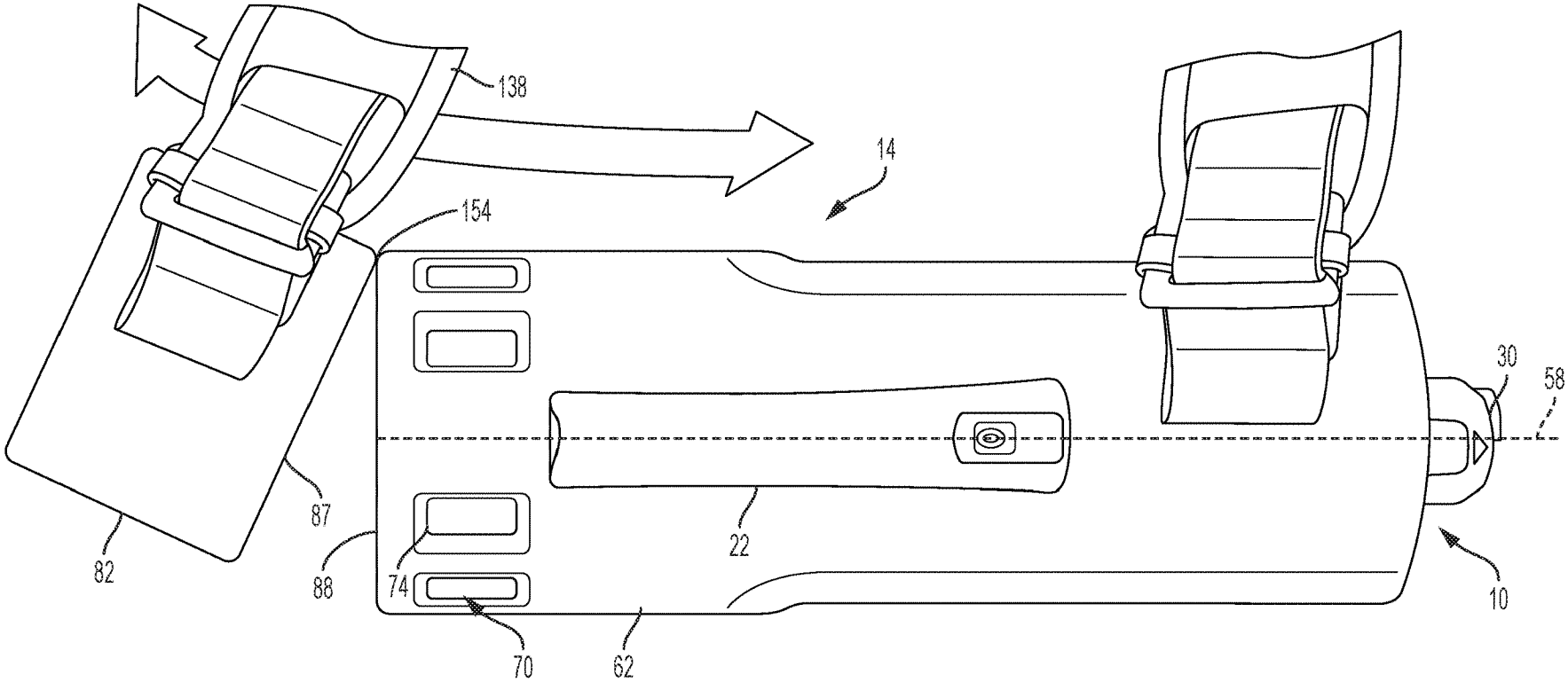
FIG. 3 is a top view of the vacuum cleaner and carrier assembly of FIG. 1, depicting a movable connection between a battery receiving portion of the carrier and a main body of the carrier.

In the embodiment illustrated in FIG. 3, the battery receiving portion 82 is pivotally coupled to the main body 62 by a thin strip of material that acts as a hinge 154. In this embodiment, the hinge 154 is the same material as the main body 62 and the battery receiving portion 82; however, in alternative embodiments the hinge 154 can be a different material or separate part. As such, the battery receiving portion 82, the battery receptacle 86, and the battery 38 are movable relative to the main body 62 and the vacuum cleaner 10. The wire 90 passes through the hinge 154 to maintain the electrical connection between the receptacle 86 and the suction source 26 (FIG. 1). Alternatively, the wire 90 can be a coiled wire, routed outside the hinge, which is able to extend and retract to accommodate relative movement of the battery receiving portion 82.

The illustrated battery receiving portion 82 is pivotable about an axis that is transverse to the longitudinal axis 58. This arrangement advantageously provides improved ergonomics and can allow the battery receiving portion 82 and the main body 62 to conform to a user's body, particularly when suspended by the shoulder sling 138. In some embodiments, one or more zippers, snaps, Velcro regions, or other suitable means can be provided to selectively secure the battery receiving portion 82 in a desired position relative to the main body 62.

With continued reference to FIG. 3, in the illustrated embodiment, the battery receiving portion 82 includes a first end wall 87, and the plenum includes a second end wall 88. In some embodiments, one or both of the end walls 87, 88 are made of the same foam and optional covering construction as the main body 62. Alternatively, one or both of the end walls 87, 88 can be made of other materials (e.g., plastic). In some embodiments, the first end wall 87 includes one or more openings or perforations to allow an airflow through the first end wall 87 to cool the battery 38, and the battery receiving portion 82 may also include other openings or perforations to promote cooling. The second end wall 88 can also include one or more openings or perforations such that a portion of the exhaust airflow may be discharged from the plenum 70 through the perforations in the second end wall 88. In some embodiments, the portion of the exhaust airflow may pass through both the second end wall 88 and the first end wall 87 to cool the battery 38. Alternatively, one or both of the end walls 87, 88 can have a solid (i.e. substantially airtight) construction.

In some embodiments, the carrier 14 may further include a bag or pocket (not shown) defining an internal volume that provides additional storage for carrying items such as batteries, cleaning attachments, cleaning supplies, or other items. For example, in such embodiments, the carrier 14 may be used to support and carry the vacuum cleaner 10, the battery 38, and one or more additional items simultaneously. The bag or pocket may be attached to the carrier 14 at any desired location, such as at the main body 62, at the battery receiving portion 82, or at the shoulder sling 138, for example. In some embodiments, the bag or pocket can be releasably attached to the carrier 14 by snaps, Velcro, buckles, a zipper, or any other suitable means. In other embodiments, the bag or pocket is permanently fastened to the carrier 14 (e.g., by stitching). In yet other embodiments, the bag or pocket is integrally formed with at least a portion of the carrier 14. For example, the bag or pocket may be integrated into the optional covering material. In some embodiments, the bag or pocket may be configured as a third compartment attached by a hinge to the main body 62, the battery receiving portion 82, or both.

Thus, the vacuum cleaner 10 is usable with a carrier 14 to facilitate operating, carrying, and/or storing the vacuum cleaner 10 and the battery 38. Although the carrier 14 is described for use with the handheld vacuum cleaner 10, the carrier 14 could also be used with other types of vacuum cleaners such as wet/dry vacuum cleaners, canister vacuum cleaners, and other types and styles of vacuum cleaners, as well as other powered devices such as power tools, outdoor power equipment, and the like.

Figure 5:
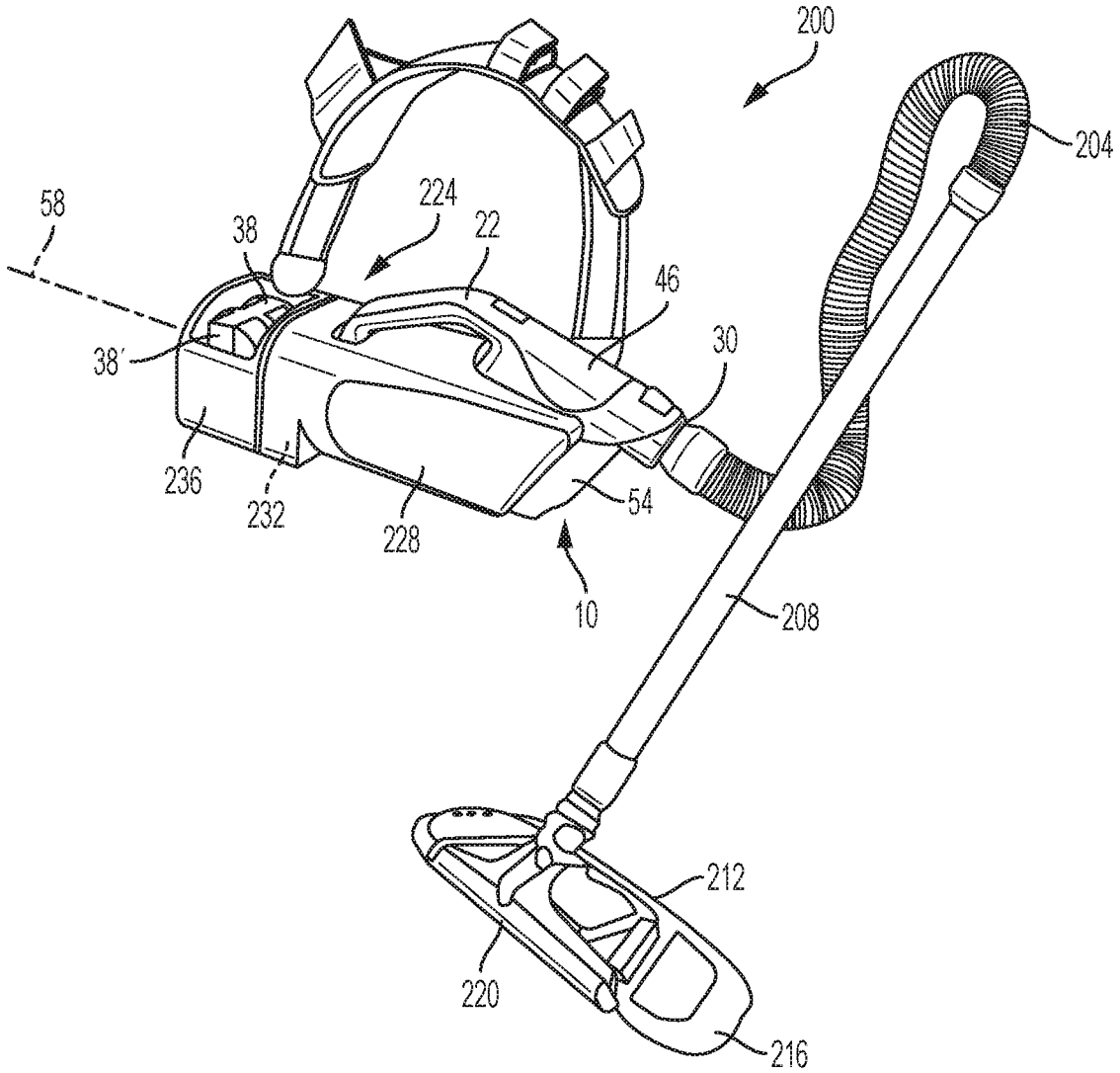
FIG. 5 is a perspective view of a vacuum cleaner and carrier assembly according to second embodiment.
Figure 6:
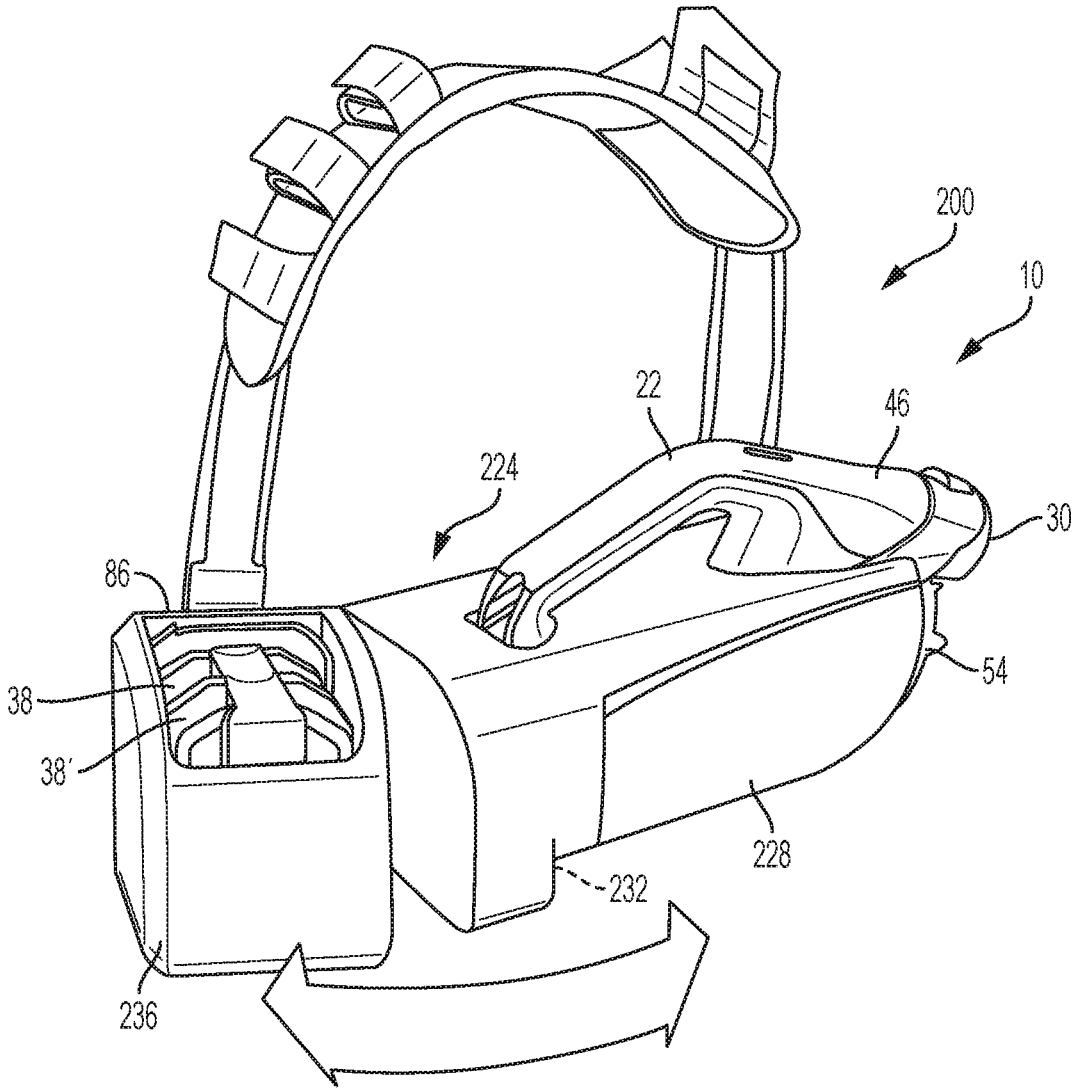
FIG. 6 is a perspective view of the vacuum cleaner and carrier assembly of FIG. 5.
Figure 7:
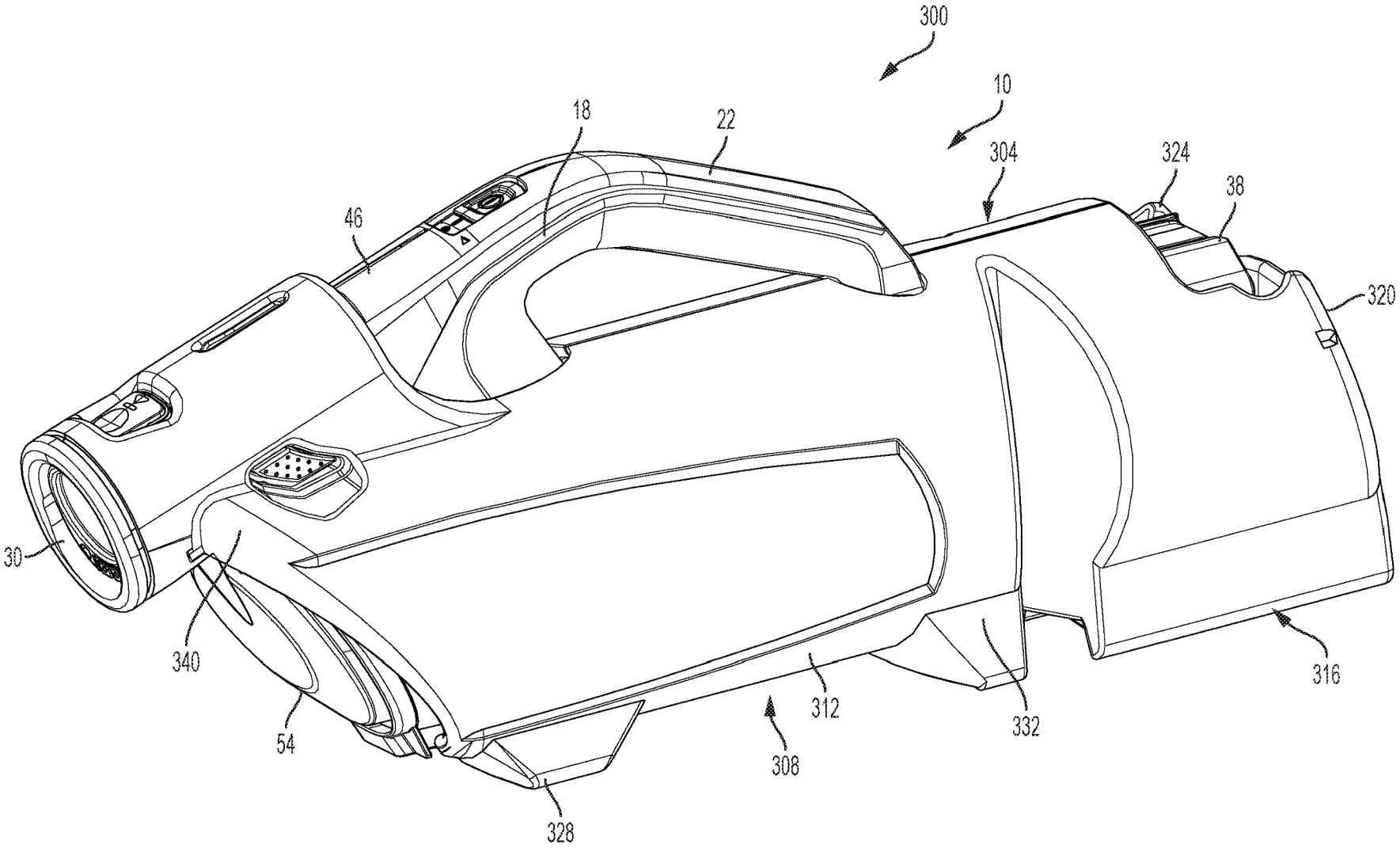
FIG. 7 is a side perspective view of a vacuum cleaner and carrier assembly according to a third embodiment.

FIGS. 5 and 6 illustrate a second embodiment of a vacuum cleaner and carrier assembly 200. The vacuum cleaner 10 and battery 38 illustrated in FIGS. 5 and 6 are the same as the vacuum cleaner 10 and battery 38 described with reference to the vacuum cleaner and carrier assembly of FIGS. 1-4B. However, the vacuum cleaner 10 of FIG. 5 is shown with an optional hose 204 attached to the suction inlet 30, a wand 208 attached to the opposite end of the hose 204, and a floor cleaning head 212 attached to the opposite end of the wand 208. The floor cleaning head 212 includes a dust cloth 216 and a suction nozzle 220 that draws in dirt and air to be delivered to the separator 42 through the wand 208, hose 204, and inlet duct 46. Other accessory tools can be used in various combinations with or instead of the hose 204, wand 208, and floor cleaning head 212.

The vacuum cleaner and carrier assembly 200 of FIGS. 5 and 6 includes a carrier 224 similar to the carrier 14 described with reference to the vacuum cleaner and carrier assembly of FIGS. 1-4B except for the differences detailed below. First, the main body 228 includes downwardly-directed exhaust openings (not shown) on the bottom of the main body 228 that allow the exhausted working air from the air outlets 34 of the vacuum cleaner 10 to exit the plenum 232 of the main body 228 in a downward direction. Second, the battery receiving portion 236 is sized to receive and store two batteries 38, 38'. The first battery 38 connects to the battery receptacle 86 and powers the vacuum cleaner 10 in a similar manner as described with the first embodiment (FIGS. 1-4B), except that the orientation of the battery receptacle 86 is rotated 90 degrees such that the receiving surface of the battery receptacle faces sideways relative to the vacuum cleaner 10 (i.e., in a direction orthogonal to the axis 58) rather than rearwardly relative to the vacuum cleaner 10 (i.e., in a direction aligned with the axis 58) as previously described for the first embodiment. The second battery 38' is placed directly in back of the first battery 38. The second battery 38' is a back-up battery such the when the first battery 38 is fully discharged and can no longer sufficiently power the vacuum cleaner 10, the first battery 38 can be removed from the battery receptacle 86 and replaced with the second battery 38' to power the vacuum cleaner 10. The first battery 38 can either be stored in the battery receiving portion 236 for later charging or can be immediately connected to a charger leaving half of the battery receiving portion 236 empty. In an alternative embodiment, the battery receiving portion 236 may be configured to hold one battery 38.

FIGS. 7-15 illustrate a third embodiment of a vacuum cleaner and carrier assembly 300. The vacuum cleaner 10 and battery 38 illustrated in FIGS. 7-15 are the same as the vacuum cleaner 10 and battery 38 described with reference to the vacuum cleaner and carrier assembly of FIGS. 1-4B. However, the vacuum cleaner and carrier assembly 300 of FIGS. 7-15 includes a carrier 304 similar in many respects to the carrier 14 of the first embodiment, except having a different configuration described in greater detail below.

The carrier 304 includes a first compartment 308 that defines a main body 312 and a second compartment 316 that defines a battery receiving portion 320. The first compartment 308 and the second compartment 316 are pivotably coupled together with a hinge 324. The hinge 324 is aligned with the axis 58 such that from a top view, the hinge 324 is positioned on the centerline of the carrier 304. The centrally-located hinge 324 allows the operator to comfortably support the vacuum cleaner and carrier assembly 300 from either their left or right shoulder with a shoulder sling (not shown) and to have the pivoting compartments 308, 316 of the carrier 304 wrap around the operator's waist.

Figure 9:
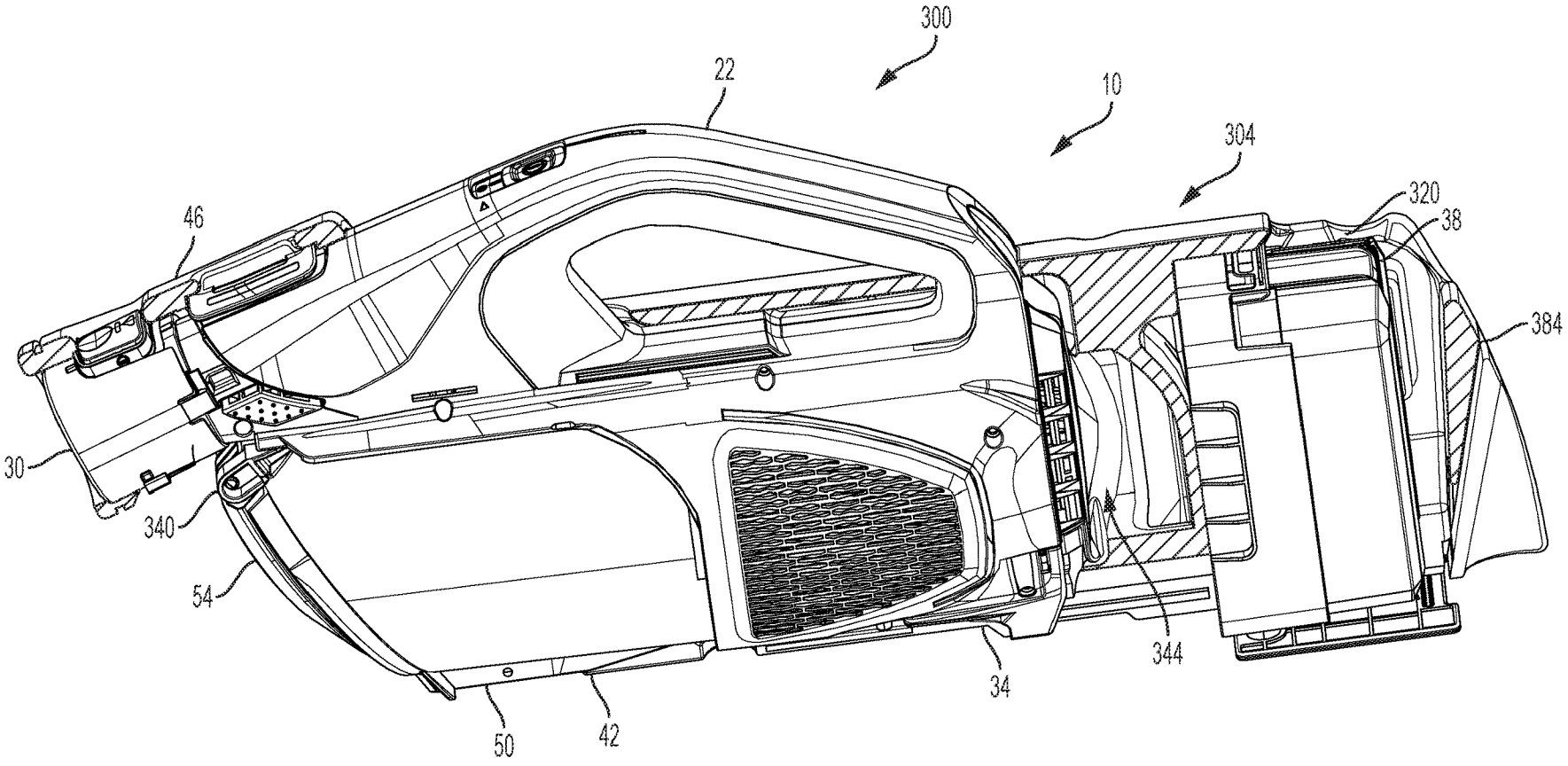
FIG. 9 is a side perspective view of the vacuum cleaner and carrier assembly of FIG. 7 with a side portion of the carrier removed.
Figure 10:
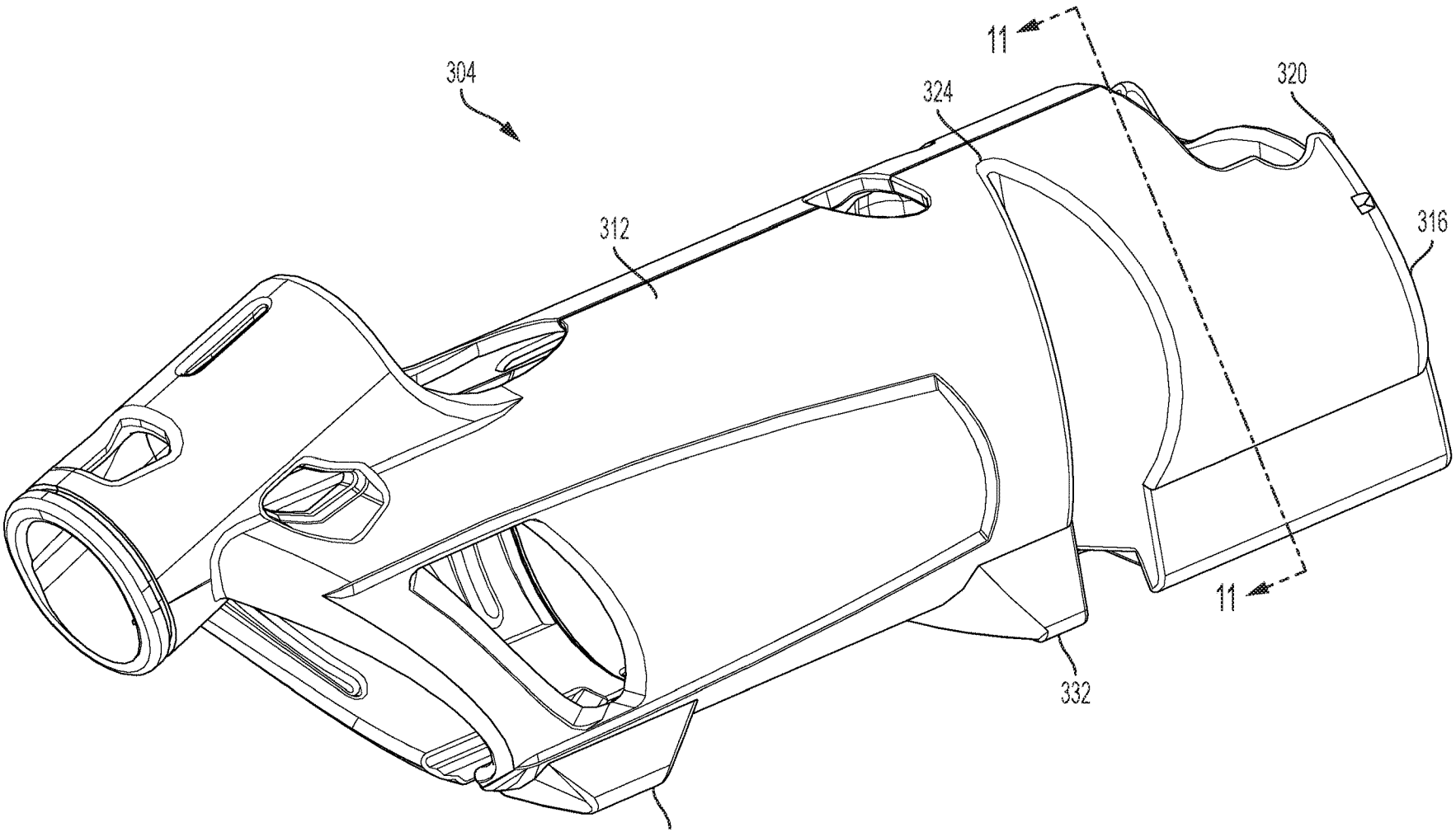
FIG. 10 is a perspective view of a portion of the carrier of the vacuum cleaner and carrier assembly of FIG. 7
Figure 11:
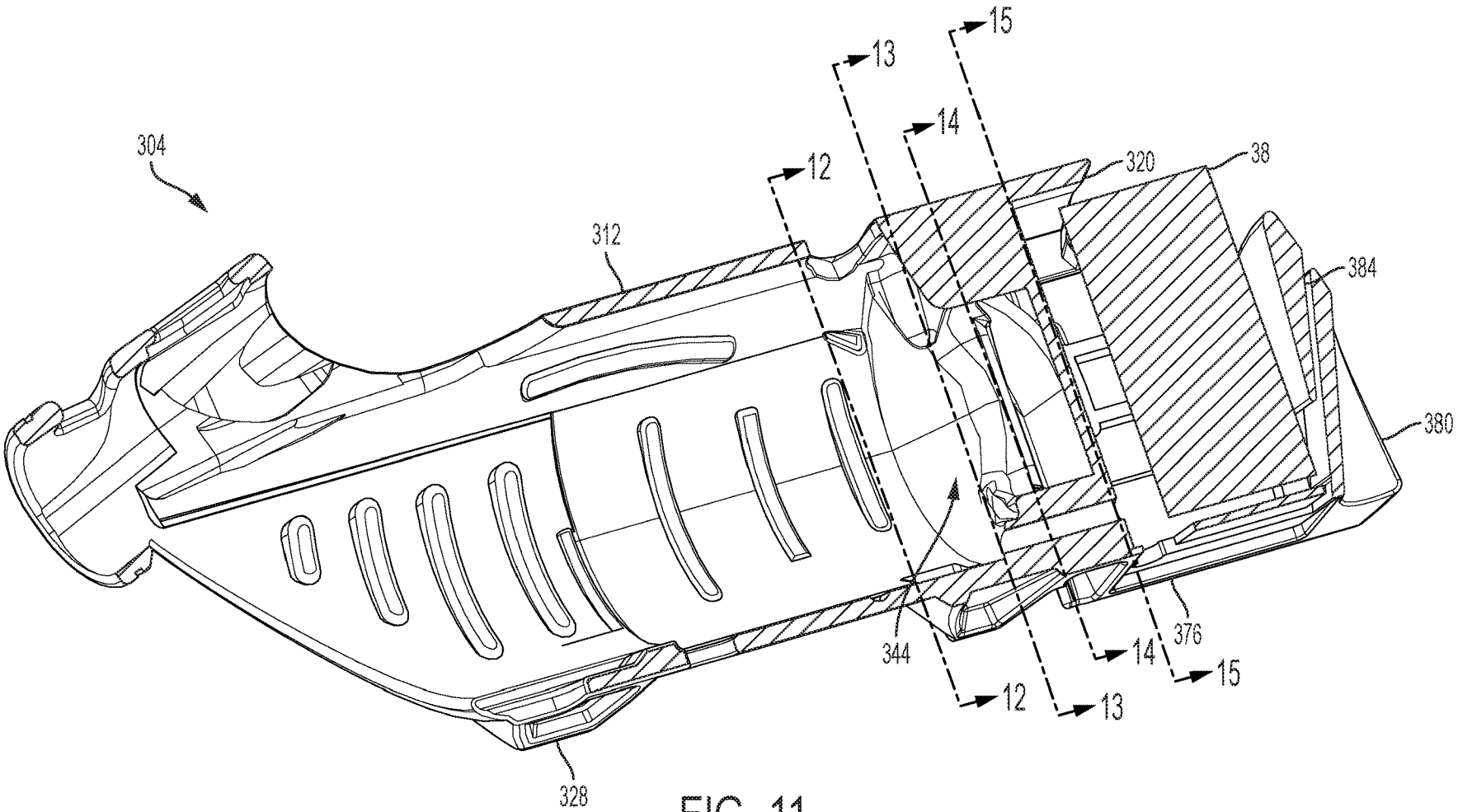
FIG. 11 is a cross-section view taken along line 11-11 in FIG. 10.
Figure 12:
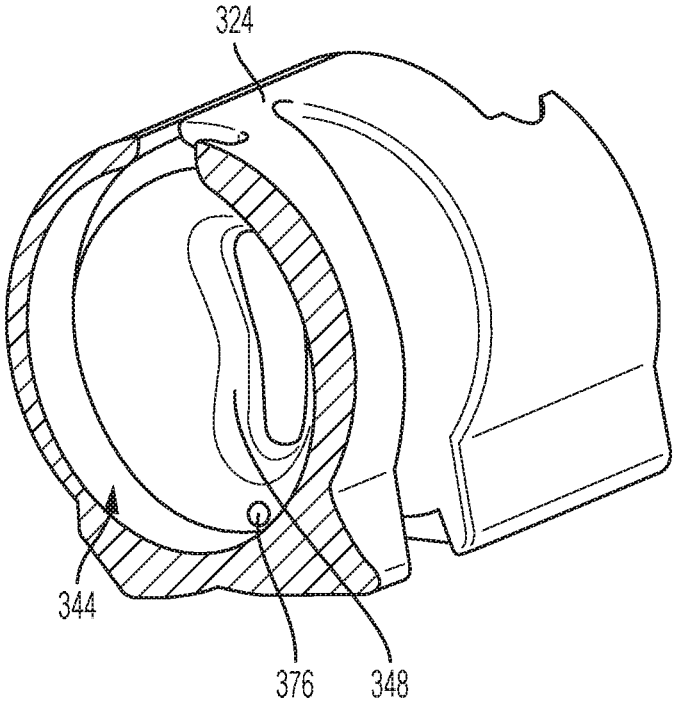
FIG. 12 is a cross-section view taken along line 12-12 in FIG. 11.

The main body 312 optionally includes a pair of front supports 328 and a pair of rear supports 332 that extend outwardly from the bottom of the main body 312 to support the vacuum cleaner upright 10 on a horizontal surface. The carrier 304 includes a slit 336 between the two lateral sides of the carrier 304 and passing between the pair of front supports 328. The slit 336 allows enough deflection of the main body 312 to allow the dirt cup 50 to be removed when the dirt cup release button 340 is depressed. The main body 304 defines a first exhaust plenum 344 at the back end of the vacuum cleaner 10 within the main body 304. As shown in FIGS. 9, 11, and 12, the first exhaust plenum 344 is positioned between the back end of the vacuum cleaner 10 and the hinge 324 such that substantially all of the exhaust air leaving the air outlet 34 is forced through an exhaust passageway 348 through the hinge 324.

Upon passing through the exhaust passageway 348 (FIG. 13), the exhaust air enters a second exhaust plenum 352 (FIG. 14) defined within the second compartment 316. The second exhaust plenum 352 is disposed between the exhaust passageway 348 and a wall 356 dividing the second exhaust plenum 352 from the battery receiving portion 320. The second compartment 316 defines exhaust openings 360 (see also FIG. 8) that direct the majority of the exhaust air out the bottom of the carrier 304. In the illustrated embodiment, the wall 356 includes first and second slots 364 positioned on opposite sides of the axis 58 allowing a portion of the exhaust air from the second exhaust plenum 352 to pass.

Figure 13:
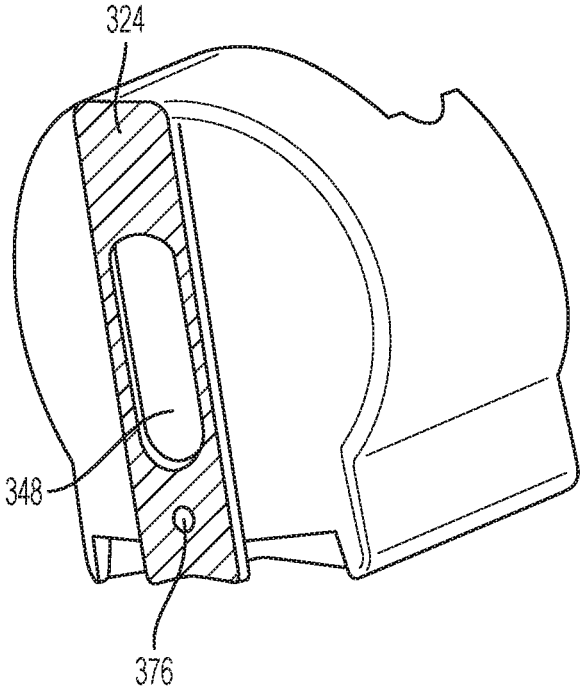
FIG. 13 is a cross-section view taken along line 13-13 in FIG. 11.
Figure 14:
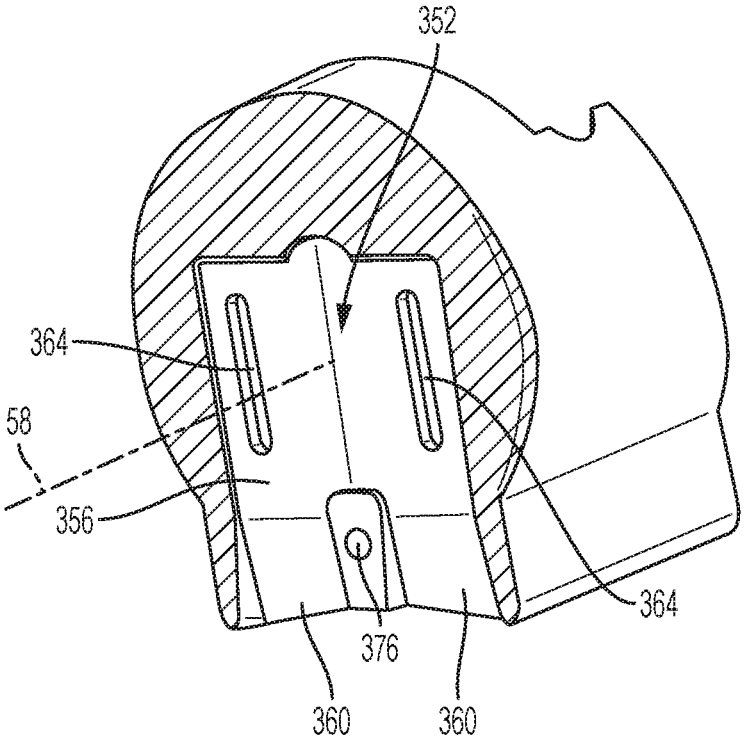
FIG. 14 is a cross-section view taken along line 14-14 in FIG. 11.
Figure 15:
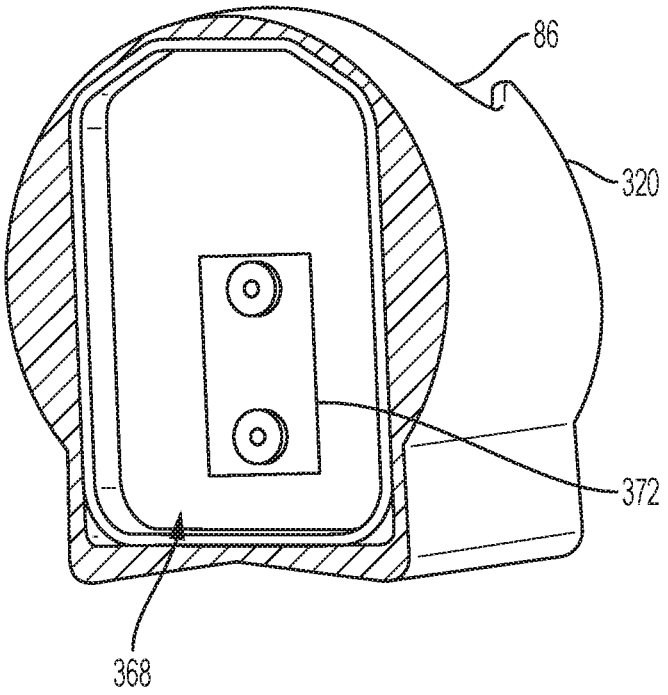
FIG. 15 is a cross-section view taken along line 15-15 in FIG. 11.

Rearward of the wall 356, the second compartment 316 includes a cooling plenum 368 forward of the battery receptacle 86 (FIG. 15). The battery receptacle 86 forms a solid barrier that prevents the air in the cooling plenum 368 from passing further in the rearward direction toward the battery 38. Instead, the air in the cooling plenum circulates within the cooling plenum over a battery control board 372 to cool the board 372. The heated air can then pass back through the slots 364 from which it came and then exit the second exhaust plenum 352 through the exhaust openings 360 during operation of the vacuum cleaner 10. The battery receiving portion 320 does not include a lid, and thus the battery is exposed to ambient air for cooling. As shown in FIGS. 9, 13, and 14, the hinge 324 and the wall 356 both include a cord passage 376 receiving the cord that electrically connects the battery receptacle to the vacuum cleaner 10. In alternative embodiments, the slots 364 and plenum 368 may be omitted where airflow directed toward the battery 38 and/or battery control board 372 is not required. In yet another embodiment, one or more outlets (not shown) may be provided through the main body 312 from the first exhaust plenum 344 to reduce the air flow through the passageway 348.

Figure 8:
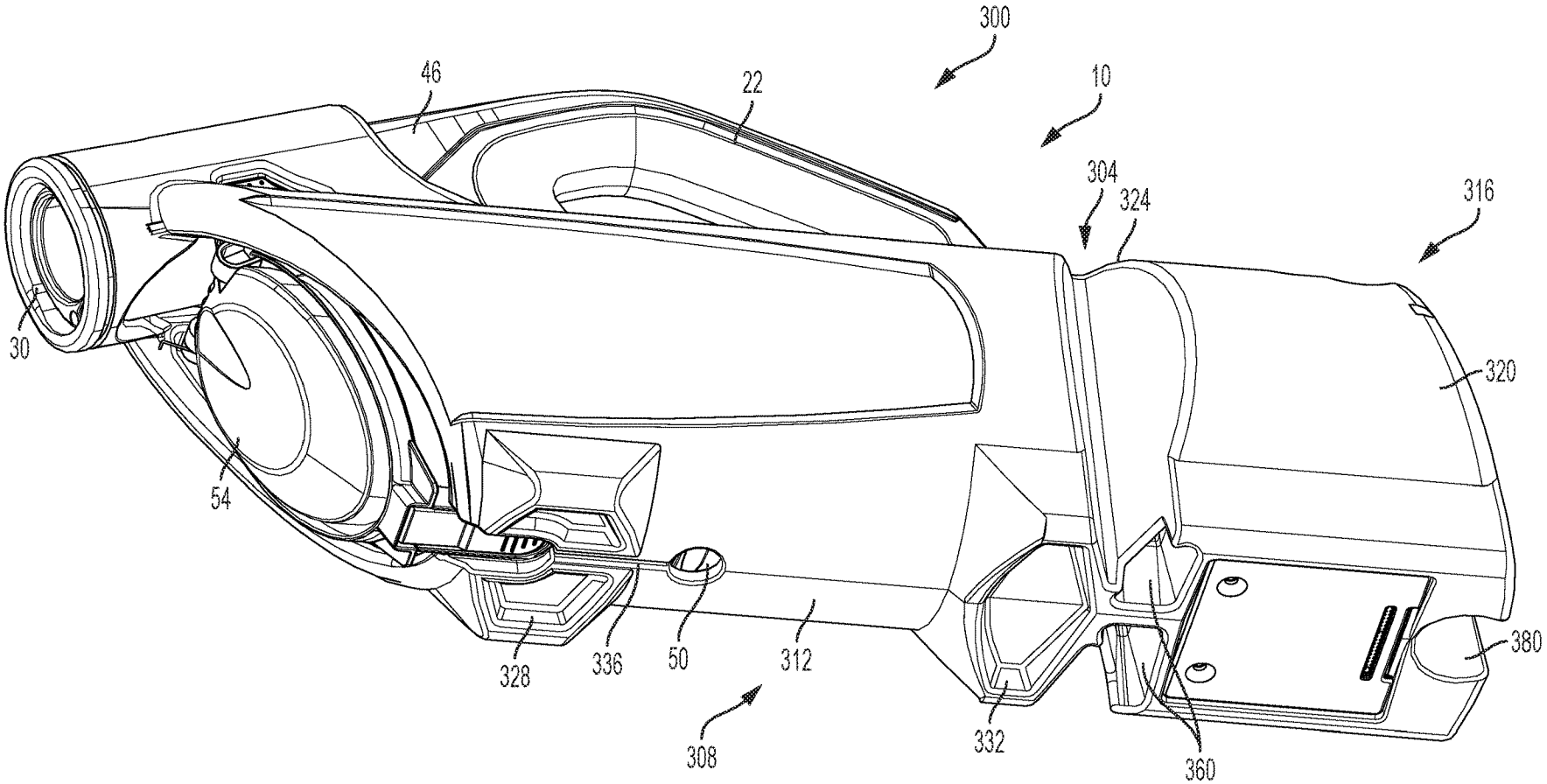
FIG. 8 is bottom perspective view of the vacuum cleaner and carrier assembly of FIG. 7.

In the embodiment of FIGS. 8 and 9, the rearmost end of the carrier 304 and battery receiving portion 320 includes a tubular slot 380 sized to receive and hold an accessory tool such as a wand, hose, crevice tool, or the like. Further, the rearmost end of the carrier 304 includes an angled slot 384 for receiving a strap (not shown) that passes through the slot 384 and is secured to the bottom of the battery receiving portion 320. The opposite end of the strap is exposed at the top end of the slot 384 and includes a D-ring that is selectively coupled to the shoulder sling with a clip.

Similar to previous embodiments, the first compartment 308 (e.g., main body 312 and first exhaust plenum 344), the second compartment 316 (e.g., second exhaust plenum 352 and battery receiving portion 320), and the hinge 324 may be integrally formed from a flexible and resilient foam material, such as a flexible foam of polyurethane, polyether, polyisocyanurate, rubber, or any combinations thereof, or other polymeric foams. In alternative embodiments, the hinge 324 can be a different material or separate part. Optionally, the foam material is covered with an outer layer of textile, film, or cladding covering material providing one or more surface properties such as water repellency, griping surface, soft surface, other tactile surface, chemical resistance, protective surface, strength, reinforcement, reflective or high-visibility surface, decoration, or other properties as desired. The optional covering material can include natural fibers, artificial fibers, polymers, metallic materials, or a combination thereof. The integrally formed foam material may be cast into halves or multiple components and then glued together around the vacuum cleaner 10.

Figure 16:
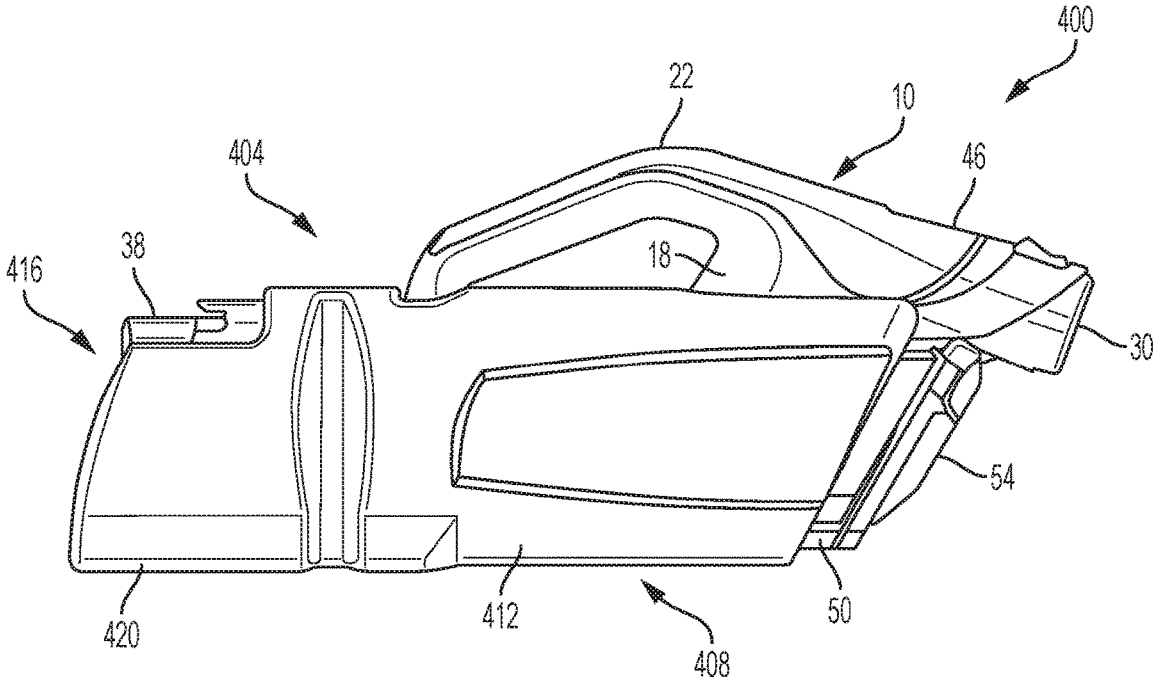
FIG. 16 is a side view of a vacuum cleaner and carrier assembly according to a fourth embodiment.
Figure 17:
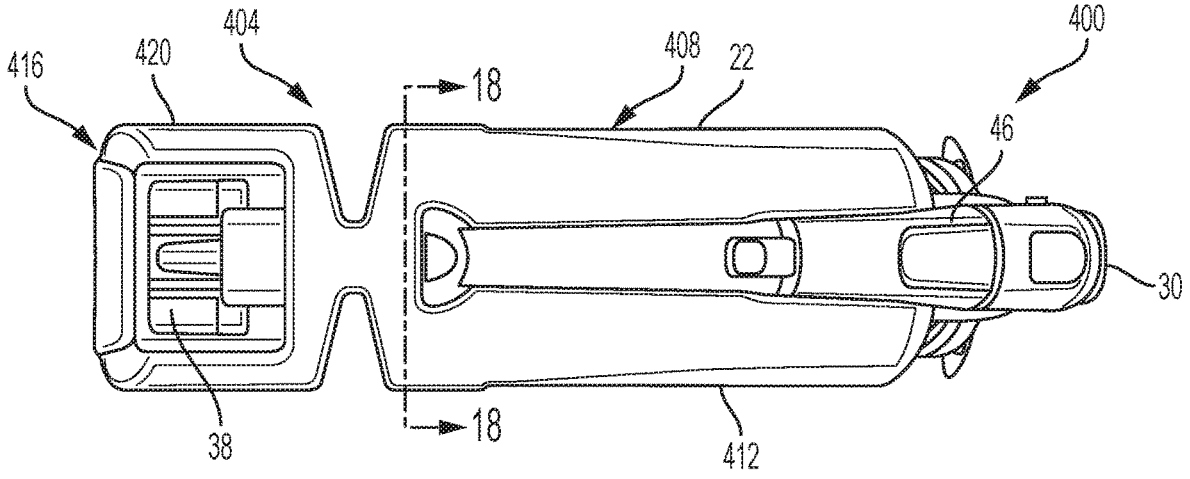
FIG. 17 is a top view of the vacuum cleaner and carrier assembly of FIG. 16.
Figure 18:
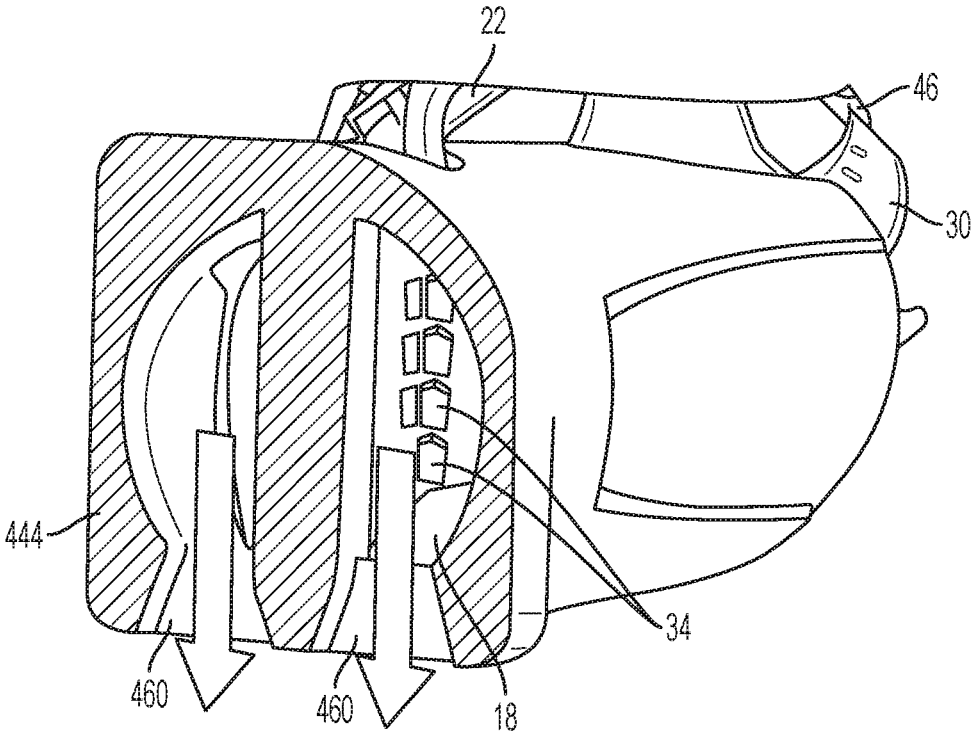
FIG. 18 is a cross-section view taken along line 18-18 in FIG. 17.

FIGS. 16-18 illustrate a fourth embodiment of a vacuum cleaner and carrier assembly 400. The vacuum cleaner 10 and battery 38 illustrated in FIGS. 16-18 are the same as the vacuum cleaner 10 and battery 38 described with reference to the vacuum cleaner and carrier assembly 300 of FIGS. 7-15. In addition, the vacuum cleaner and carrier assembly 400 of FIGS. 16-18 includes a carrier 404 similar to the carrier 304 of the third embodiment, except for a having a different exhaust air path. Specifically, a single exhaust plenum 444 is defined by the main body 412 of the first compartment 408 on the upstream side of the hinge 424 such that no exhaust air passes through the hinge 424 to the second compartment 416 or battery receiving portion 420. Rather, the exhaust air passes through openings 460 in the bottom of the main body 412 through openings 460 that direct the exhaust air downwardly.

It should be noted that features described relative to one embodiment of the vacuum cleaner and carrier assembly can be incorporated into or substituted for similar features of other described embodiments of the vacuum cleaner and carrier assemblies. For example, certain alternative designs may be described relative to one embodiment, but not introduced again when another embodiment is described for the sake of brevity. The alternative designs are equally applicable to the other embodiments in addition to the one for which it was specifically described.

All of the embodiments described above include a carrier with first and second compartments pivotably joined by a hinge. The first and second embodiments each includes a first compartment having a main body housing a vacuum cleaner housing and defining an exhaust plenum, an offset hinge, and a second compartment defining a battery receiving portion. The third embodiment illustrates a first compartment that includes a main body housing a vacuum cleaner housing and a first exhaust plenum, a centrally-located hinge that includes an exhaust passageway and cord passage, and a second compartment that defines a second exhaust passageway, a cooling plenum, and a battery receiving portion. Finally, the third illustrated embodiment includes a carrier with a first compartment including a main body housing a vacuum cleaner housing and defining an exhaust plenum, a centrally-located hinge, and a second compartment defining a battery receiving portion. Alternative designs in which each of the first and second compartments define any one or more combination of functions including housing the vacuum cleaner, defining one or more exhaust plenums, defining one or more battery receiving portions, and defining one or more cooling plenums are contemplated and considered to be within the scope of present invention.

Various features of the invention are set forth in the following claims.

What is claimed is:

1. A vacuum cleaner comprising:

a body formed by a foam material, the body having a first end and a second end;

an air inlet adjacent the first end, an air outlet, and an airflow passage that extends from the air inlet to the air outlet;

a suction source disposed within the body operable to generate an airflow that travels from the air inlet through the air outlet;

a separator in communication with the airflow passage operable to filter dirt from the airflow; and a battery releasably mounted to a battery receiving portion operable to supply power to the suction source when the battery is mounted to the battery receiving portion;

wherein the battery receiving portion is in the second end of the body.

2. The vacuum cleaner of claim 1, further comprising at least one shoulder strap having a first end connected to the first end and a second end connected to the second end as a shoulder harness for carrying as a back-pack.

3. The vacuum cleaner of claim 1, further comprising a hose releasably connected to the air inlet.

4. The vacuum cleaner of claim 1, wherein the body is formed using a flexible foam material.

5. The vacuum cleaner of claim 1, further comprising a battery receptacle supported within the battery receiving portion, the battery receptacle being in electrical communication with the suction source.

6. The vacuum cleaner of claim 5, the battery receptacle including a latching mechanism engageable with the battery to releasably secure the battery to the receptacle.

7. The vacuum cleaner of claim 1, wherein the battery has a housing enclosing one or more rechargeable lithium-ion type battery cells.

8. The vacuum cleaner of claim 1, wherein the battery receiving portion is integrally made of the same foam as the body.

9. The vacuum cleaner of claim 8, the battery receiving portion further comprising one or more rigid supports configured to inhibit the battery receiving portion from being compressed.

10. The vacuum cleaner of claim 1, wherein the foam material is covered with an outer layer of textile, film, or cladding providing one or more surface properties selected from a group consisting of water repellency, griping surface, soft surface, tactile surface, chemical resistance, protective surface, strength, reinforcement, reflective surface, high-visibility surface, and decoration.

11. A vacuum cleaner comprising:

a foam body;

an air inlet that extends through the foam body;

an air outlet that extends through the foam body;

a suction source disposed within the foam body operable to generate an airflow that travels from the air inlet through the air outlet;

a separator within the foam body, the separator in communication with the air inlet and operable to filter dirt from the airflow; and a battery that supplies power to the suction source, wherein the foam body includes an aperture and the battery is removable from the vacuum cleaner through the aperture.

12. The vacuum cleaner of claim 11, wherein the foam body includes a plenum for the airflow generated by the suction source.

13. The vacuum cleaner of claim 11, wherein the air outlet includes a plurality of openings through the foam body.

14. The vacuum cleaner of claim 11, wherein the foam body includes a first portion and a second portion pivotally coupled to the first portion, wherein the suction source is disposed within the first portion of the foam body for pivotally movement with the first portion relative to the second portion, wherein the battery is disposed within the second portion of the foam body.

15. The vacuum cleaner of claim 14, wherein the foam body includes a plenum for the airflow generated by the suction source, wherein the plenum is disposed within the first portion of the foam body.

16. The vacuum cleaner of claim 14, further comprising a fastener that selectively secures the first portion in a desired position relative to the second portion.

17. The vacuum cleaner of claim 16, wherein the fastener includes a zipper.

18. The vacuum cleaner of claim 14, further comprising shoulder strap for carrying the vacuum cleaner as a back-pack, the shoulder strap including a first end connected to the first portion of the foam body and a second end connected to the second portion of the foam body.

19. The vacuum cleaner of claim 11, further comprising shoulder strap for carrying the vacuum cleaner as a back-pack.

20. The vacuum cleaner of claim 11, further comprising a hose releasably connected to the air inlet.

* * * * *